United States Patent [19]

Pryor

[11] Patent Number: 4,697,713

[45] Date of Patent: Oct. 6, 1987

[54] CLOSET STORAGE ARRANGEMENT

[76] Inventor: Nicholas Pryor, 8963 Burton Way #304, Los Angeles, Calif. 90048

[21] Appl. No.: 761,801

[22] Filed: Aug. 2, 1985

Related U.S. Application Data

[63] Continuation-in-part of Ser. No. 366,536, Apr. 8, 1982, abandoned.

[51] Int. Cl.[4] ..... A47F 5/00

[52] U.S. Cl. ..... 211/189; 211/34; 211/37

[58] Field of Search ..... 211/34, 37, 35, 86, 211/123, 105.1, 189, 32, 87

[56] References Cited

U.S. PATENT DOCUMENTS

| | | | |
|---|---|---|---|
| 3,913,745 | 10/1975 | Weiss | 211/34 |
| 4,209,099 | 6/1980 | Wickes | 211/182 |

FOREIGN PATENT DOCUMENTS

| | | | |
|---|---|---|---|
| 501564 | 4/1954 | Canada | 211/35 |
| 1206143 | 8/1959 | France | 211/37 |
| 195888 | 10/1964 | Sweden | 211/206 |
| 678852 | 9/1952 | United Kingdom | 211/34 |

*Primary Examiner*—Robert W. Gibson, Jr.

*Attorney, Agent, or Firm*—Burns, Doane, Swecker & Mathis

[57] ABSTRACT

A closet storage arrangement is provided which incorporates a shoe storage facility and permits conventional size closet areas to be utilized so as to increase their capacity for the storage of clothes and footwear. The footwear storage section accommodates a variety of footwear for both men and women. The footwear support section is integrated with the closet structure so as to provide good capacity for storage of clothes as well as shoes while concurrently offering convenience in the introduction and retrieval of articles.

17 Claims, 15 Drawing Figures

Fig. 2
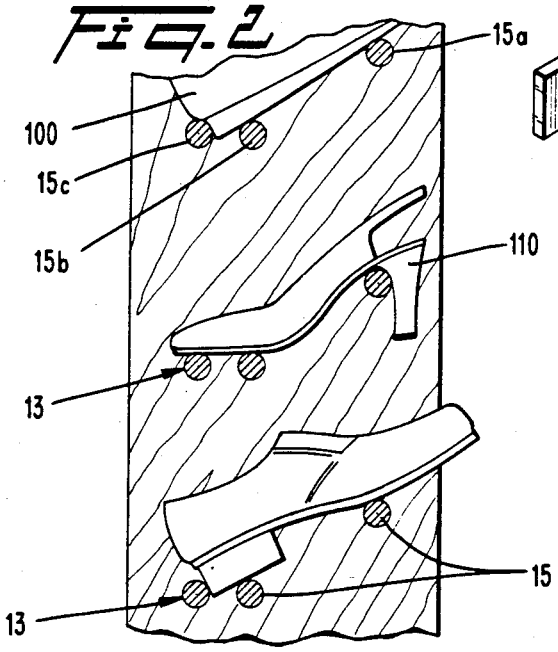
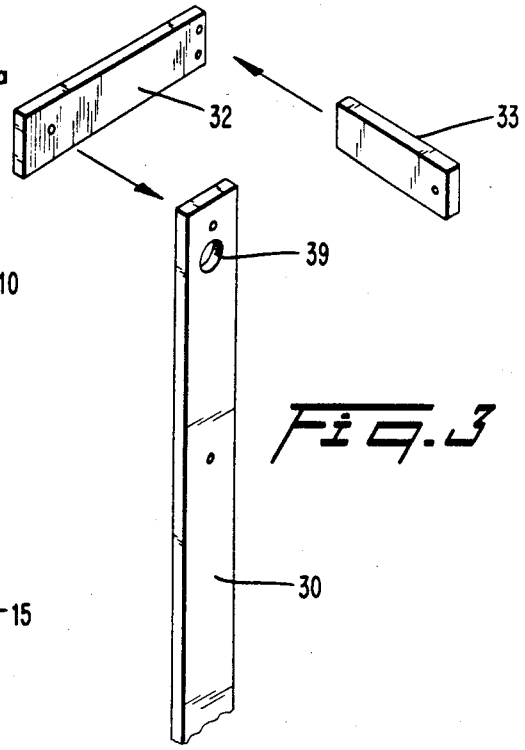
Fig. 3
Fig. 4
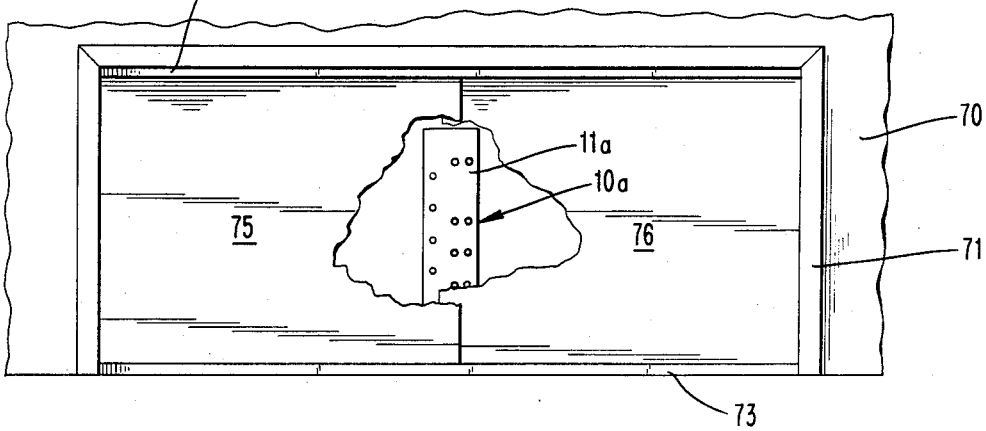
Fig. 5
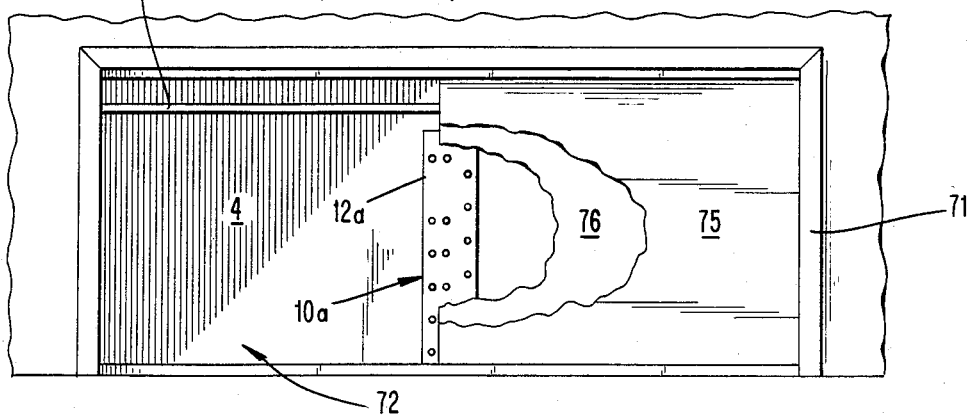

203
221
221
221
202
221
206
202
208
221
206
220
202
222
226
202
224
206
206
208
204
228

Fig. 13
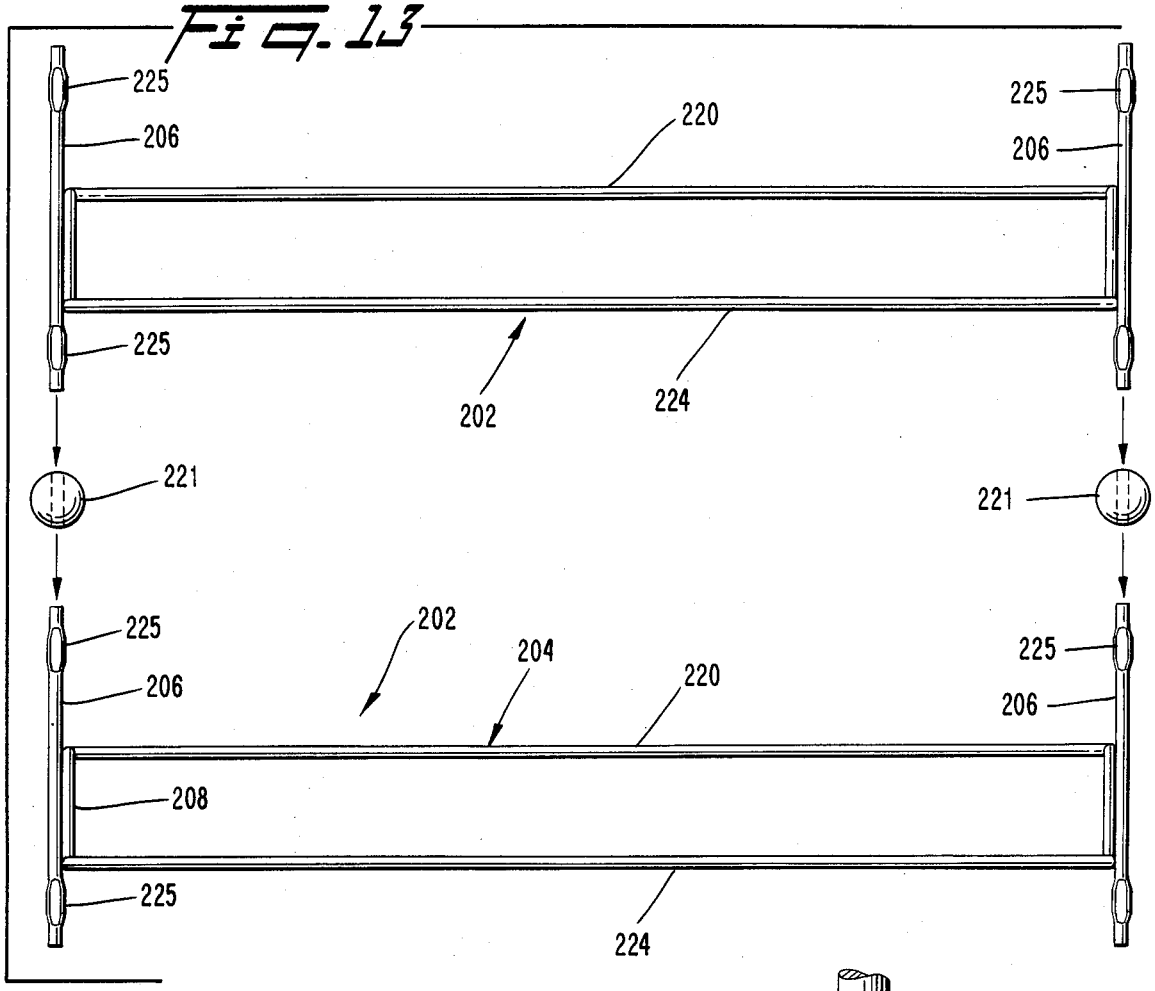
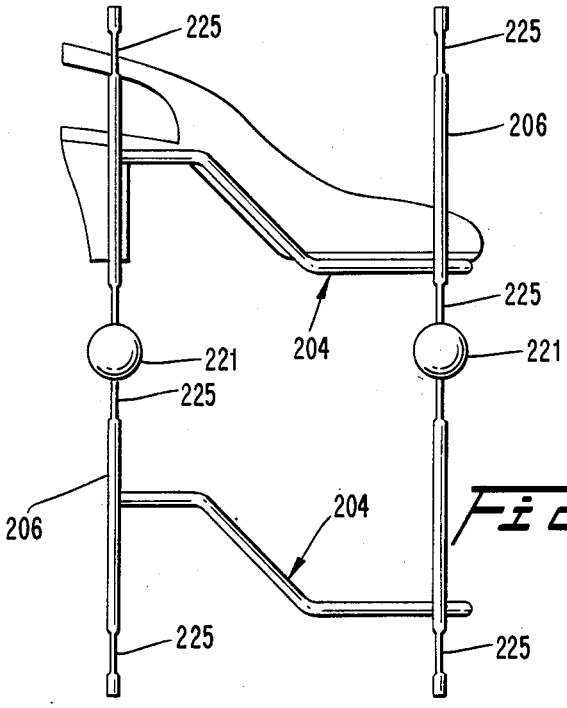
Fig. 14
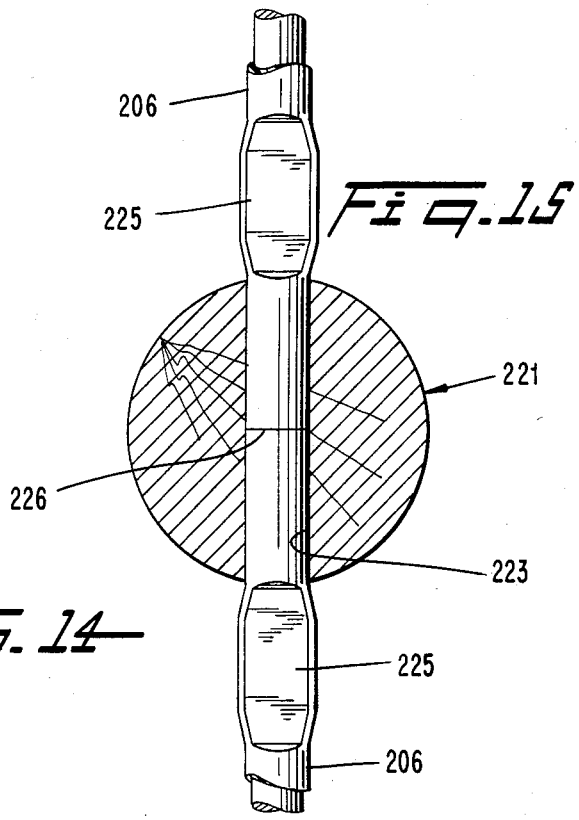
Fig. 15

CLOSET STORAGE ARRANGEMENT

RELATED APPLICATION

This is a Continuation-In-Part of U.S. application Ser. No. 366,536, filed Apr. 8, 1982 now abandoned by Nicholas Pryor.

BACKGROUND AND SUMMARY OF THE INVENTION

The present invention relates generally to household storage of shoes. It is concerned particularly with closet arrangements and shoe cases.

Conventional closet storage arrangements, in even the costliest new housing, serve the builder rather than the occupant. Wooden cleats are fastened to side walls and a back wall of the closet so that a wooden clothes pole, which is laterally suspended across the closet, will be approximately sixty-five inches above the closet floor thereby accommodating the longest garments conventionally made. A wooden shelf is rested on the cleats above the pole. Since wood will sag under any kind of load in approximately a thirty inch span, a bracket is attached to the rear wall at intervals to support both the pole and the shelf. The whole arrangement is relatively inexpensive to install but results in a large amount of wasted space in a closet at a time when the size of many persons' wardrobes has greatly expanded.

More and more people are finding that the storage space in a conventional closet is inadequate for their needs since more garment hanging space and more shoe storage space is desired to hold larger wardrobes. In a conventional closet, the many pairs of shoes that most people now own are just jumbled in a pile. Thus a convenient shoe storage structure in a closet would be desirable for the large variety of shoes ranging from sneakers to boots that many people own.

The shoe case constructions provided before the present invention for household shoe storage have been deficient in a number of respects. Some have not supported the shoes properly in the desired upright positions. Some have been inconvenient to use. Some have provided inadequate storage capacity.

It is desirable to provide a shoe storage arrangement for use in a closet to enable shoes to be kept neatly organized off the floor and yet conveniently viewed and reached. On the other hand, the available closet space and/or quantity of shoes to be stored may vary from one closet to another and may vary with time with respect to any given closet. Hence, it would be desirable that a storage arrangement be adaptable to the particular requirements of a variety of typical closets.

It is therefore, an object of the present invention to provide a closet in which large numbers of both high heel and low heel shoes can be stored conveniently with only minimal interference with the space available for hanging garments.

Another object of the invention is to provide versatile shoe case constructions adapted for effective and economical use in household closets.

Another object is to provide such a case wherein the spacing between vertically adjacent footwear supports can be varied to accommodate larger articles such as boots.

The present invention provides a household closet having enhanced capacity for storing clothing and footware for men and women. The closet has a floor, transversely spaced apart side walls, a back wall extending between the two side walls and means providing a door opening spaced forwardly from the back wall. A generally horizontal hang bar for supporting garments on hangers is mounted so that the axis thereof extends generally transversely of the the closet at a location between the back wall and the door opening. A preferably tall multi-tier shoe case is located between the side walls and faces sideways in the closet to minimize the lateral space rendered unuseable for hanging clothes. The shoe case has a rear end near the closet back wall and a front end spaced forwardly toward the door opening. The vertical sides of the shoe case are open for easy visibility of shoes therein. Each tier of the shoe case is provided by three horizontal shoe support members mounted to extend from back to front of the closet. A first of the shoe support members of each tier is located near one side of the shoe case at one level and the second and third ones of the shoe support members of each tier are located near the opposite side of the shoe case in horizontally spaced relationship to each other at another level. The horizontal spacing between the second and third support members of a tier is great enough to cause the rear of a low heel shoe whose front sole portion has been rested on the first support member to bear against an inside portion of the outermost of the second and third support members to prevent the shoe from sliding off the shoe support members. The spacing between the second and third support members and the first support member of a tier is such that a high heel shoe may be securely supported on the support members of the tier with its front sole portion resting on the second or third support members and its heel hooked over the first support member.

For maximizing footwear storage, the shoe case can be quite tall, extending upwardly beyond the level of the hang bar. In this instance, the arrangement will be such that the hang bar actually extends through the openwork shoe case construction.

For maximizing hanging storage of clothing items, a second hang bar may be located below at least a part of the length of the main hang bar and coordinated with the position of the shoe case.

In shoe cases preferred in accordance with the invention, the various tiers are preferentially accessible from one side or the other thereof. Typically, the three support members of a tier are located so that the first support member, over which the heels of ladies' high heel shoes are intended to be hooked, is at the side opposite the side through which normal access is obtained, and the second and third support members are below the first support member and at the open front face side of the unit. Men's low heel shoes are supported in an opposite orientation from high heel shoes. The low heel shoes have their heel portions at the lower level of the second and third support members and their toe portions elevated over the first support member of the tier. This disposes all the shoes in the case so that their midportions are inclined and readily available for grasping by a person's hand inserted horizontally through the open front face at a level between the second and third support members of one tier and the second and third support members of the next higher tier.

It is a further feature of the invention that the shoe case is reversible in the closet so that its open front can be directed either to the right or to the left, as viewed from the front opening of the closet, so that it may be accessed comfortably by either right handed users or left handed users.

In some shoe case embodiments in accordance with the invention, there is an inverted tier in which the rear support member is lower than the two forward support members to provide for boot storage. The heel of a boot is inserted between the support members of the pair at the front side of the tier, the sole of the toe portion of the boot is rested on the single support member at the back of the tier, and the ankle portion of the boot will extend in the desired upward direction.

A more complete understanding of the features and advantages of the invention will be gained from consideration of the detailed description which follows.

BRIEF DESCRIPTION OF THE DRAWINGS

Preferred embodiments of the present invention are described with reference to the accompanying drawings wherein like members bear like reference numerals and wherein:

FIG. 2 is an enlarged perspective view of a dowel arrangement of a shoe rack portion of the storage arrangement of FIG. 1;

FIG. 3 is an enlarged exploded view of a stilt portion of the storage arrangement of FIG. 1;

FIG. 4 is a partly broken away diagrammatic illustration of a closet having double sliding doors and having therein a shoe case similar to that of FIG. 1 arranged for convenient use by a right handed householder;

FIG. 5 is a view similar to FIG. 4 but showing the left door of the closet in its open position and showing the shoe case in a reversed orientation convenient for use by a left handed person;

FIG. 13 is an exploded front elevational view of a portion of the shoe case depicted in FIG. 12;

FIG. 14 is a side elevational view of a portion of the shoe case depicted in FIG. 12, illustrating the manner of mounting a high heel shoe thereon; and FIG. 15 is a fragmentary cross-sectional view taken through a coupling slide which holds together the posts of the modules depicted in FIG. 12.

DETAILED DESCRIPTION

Figure 1:
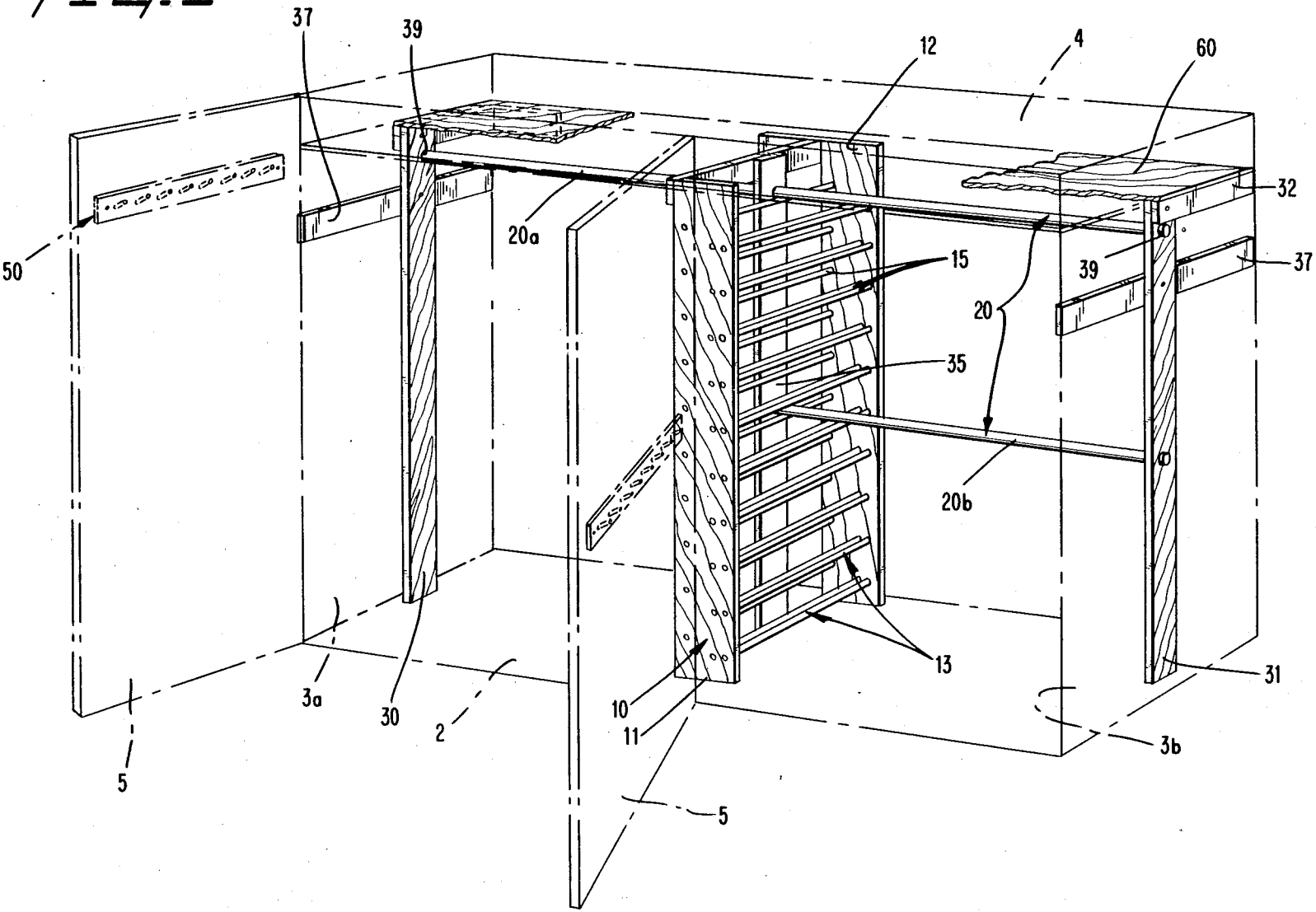
FIG. 1 is a perspective view of a closet storage arrangement according to the present invention.
Figure 6:
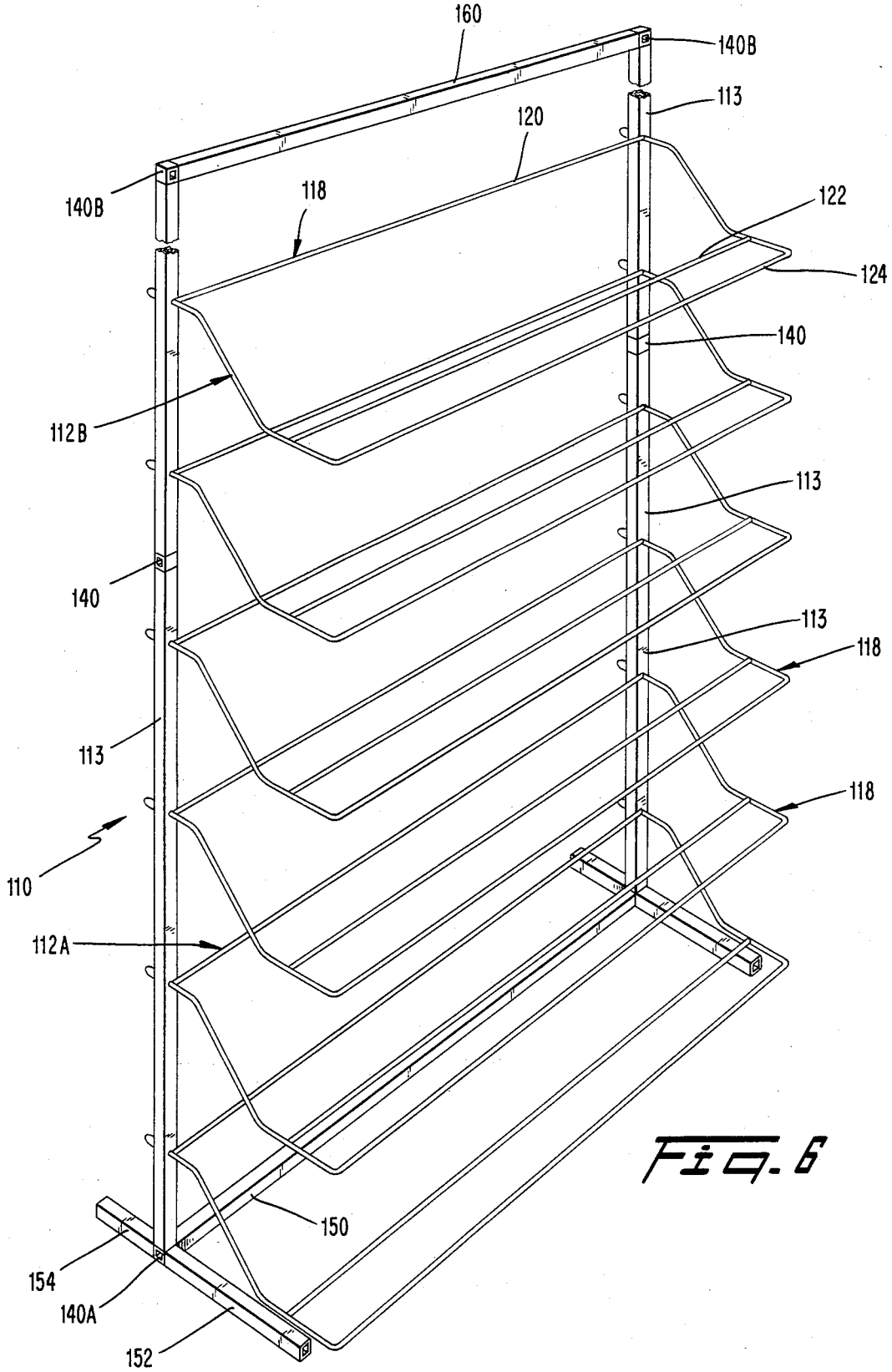
FIG. 6 is a perspective view of another form of multi-tier shoe rack, wherein a plurality of modules are in an assembled condition.

With reference to FIG. 1, a first preferred embodiment of a closet storage arrangement according to the present invention includes a closet having a floor 2, two side walls 3*a*, 3*b*, a rear wall 4 and two doors 5 with a shoe rack 10 disposed therein. Of course, the closet may have any number of doors 5 or no doors at all. The shoe rack 10 has a front side wall 11 and a rear side wall 12 with a plurality of tiers 13 for storing shoes extending therebetween. With the present arrangement, a person is able to store a large number of shoes in neat vertically spaced rows in the shoe rack 10 rather than in a pile on the floor as in a conventional closet.

Two substantially horizontal bars 20 from which clothes hangers (not illustrated) may be suspended may also be disposed in the closet instead of a conventional closet hang bar. Of the two bars 20, a top bar 20*a* extends the width of the closet and a bottom bar 20*b* extends approximately half the width of the closet. One is thus able to store a substantially greater number of clothes on the two bars 20 than would be possible in a conventional closet. A top shelf 60 is normally disposed above the two bars 20.

Each tier 13 of the plurality of tiers of the shoe rack 10 is defined by a plurality of support members 15. The support members 15 which may be rods, dowels, pins or pegs are fitted into the side walls 11, 12 of the shoe rack 10 with a tight fit. In this way the entire shoe rack 10 is held together by the snug fit of the support members 15 in the side walls of the shoe rack. For the sake of convenience, the support members 15 will be termed dowels since the support members are preferably round in cross-section and fit tightly, e.g. by a press-fit, into corresponding holes in the two shoe case side walls 11, 12 to align and fasten the two side walls with respect to each other. The dowels 15 may also be glued in place or similarly fastened between the side walls 11, 12 of the closet. Of course the dowels 15 may be square or have another type of cross-section if so desired. Since a snug fit holds together the entire shoe case 10, there is no need for a top wall or member (not illustrated) connecting the two side walls 11, 12. Of course, a top wall could be provided if desired. The shoe case side walls 11, 12 and dowels 13 are preferably made from wood because wood is inexpensive but may be made from any other suitable material.

Because there are only dowels 15 extending between the side walls 11, 12 instead of shelves, the entire shoe case 10 is open permitting all the shoes to be visible from the top tier to the bottom tier. Since the shoe case 10 is open, the hang bars 20 can also extend through the case. Therefore, the shoe rack 10 may be installed towards the doors 5 of the closet, towards the back wall 4, next to either side wall 3*a*, 3*b* of the closet or in the middle of the closet (as illustrated in FIG. 1). The location of the shoe rack 10 is normally dictated by the available space in the closet and the wishes of the user of the closet.

With a forward facing shoe rack, in order to accommodate thirty to thirty-six pairs of shoes approximately twenty-one inches of lateral inner space is required thus necessitating a shoe rack of approximately twenty-three inches of overall width in a shoe case approximately seventy-six to eighty-one inches high, if three pairs of shoes are placed side by side on each of ten to twelve levels of tiers. By the use of the present shoe rack 10 placed sideways in the closet, however, the same number of shoes can be stored in only approximately nine inches of lateral space, if the shoes are ten inches long as would be the case for most women's shoes. For men's shoes, only approximately eleven inches of lateral space would be required if the shoes were twelve inches long.

Of course more than one shoe case 10 may be installed in a closet as dictated by the particular size of the closet and the requirements of the person or persons using the closet. For example in a very long closet, such as would be used in a master bedroom, two shoe cases 10 may be installed side by side (not illustrated), one for the husband and one for the wife, with each case holding approximately thirty pairs of shoes. Normally, to hold sixty pairs of shoes would require over forty inches of lateral space. Such lateral space is then, of course, not available for hanging clothes. With a side by side placement of the shoe cases 10 of the present invention, however, the same storage of sixty pairs of shoes can be achieved in only approximately twenty inches of lateral space thus leaving more lateral space for hanging clothing.

Since most clothing hung on a hang bar does not extend the full depth of a conventional closet, normally twenty-three inches, a front pair of shoes in every one of the ten tiers 13 may be reachable without touching any clothing at all. Most clothing will fall within the plane of a standard hanger (not illustrated) which is approximately sixteen inches wide and some garments, such as folded slacks, may be even narrower. Other garments, however, such as suit jackets, quilted housecoats, down filled jackets, etc. do need the full twenty-three inches of closet depth. But because the ten tiers 13 are open dowel work and not closed shelving, all the shoes stored are visible down through the rack.

With reference now to FIG. 2 each tier 13 of the shoe rack or case 10 has three dowels 15. A back dowel member 15*a* is disposed rearwardly, preferably by approximately three to five inches, and upwardly, preferably by approximately two and one-half inches on center, of two front dowels, a front first dowel member 15*b* and a front second dowel member 15*c*. These latter two dowel members 15*b*, 15*c* are parallel to each other and are horizontally spaced from each other, preferably by approximately one and one-half inches. Of course, any other dowel spacing arrangement will suffice as long as the three dowel members 15*a*, 15*b*, 15*c* are so spaced from each other that they cooperate to hold a shoe well balanced on the tier 13.

Previously, tennis shoes 100 could not be stored in a closet shoe case having a dowel arrangement for holding shoes at an angle because the tennis shoe, having no distinct or "built up" heel for hooking on a back dowel, would slide off the dowels. In the present invention, on the other hand, the rear dowel 15*a* can be used to support a front sole portion of the tennis shoe 100 and the front second dowel member 15*b* supports a heel bottom portion of the tennis shoe so that the tennis shoe is held at an angle in the shoe case 10. The front first dowel member 15*c* supports a heel back portion of the tennis shoe and prevents it from sliding off the other dowels. The gap between the two front dowel members 15*b*, 15*c* is generous enough to catch low or no heel shoes without being so wide that slippers fall through or heels catch or snag. Gravity thus holds the tennis shoe 100 securely in position in the shoe case 10. Also, the lateral space required to store shoes is reduced by holding the shoes at an angle. For example, a twelve inch long pair of tennis shoes may be accommodated in only approximately eleven inches of lateral space in the closet thereby allowing more storage space for clothing.

In the instance of a woman's high-heeled shoe 110, a heel portion of the shoe can be hooked over the rear dowel member 15*a* while the sole of the shoe may rest on both of the front dowel members 15*b*, 15*c*. The present arrangement permits high heeled shoes 110 to be held securely, graspable from the toe. But it also permits low heeled shoes and shoes with no distinct heel, including wedgies, slippers and sneakers to be securely held and be graspable from the heel.

Of course, the shoe case or rack 10 of the present invention will accommodate both mens and womens shoes as desired. Normally, the overall width of the shoe case 10 would be approximately twenty-three inches but it may be less as required and may also be as great as forty-eight inches, if closet depth permits, since the shoe case normally needs no glueing to be stable. Since a pair of shoes is generally about seven inches wide, three pairs of shoes may easily be stored on the twenty-three inch wide shoe case. The width of the shoe case side walls 11, 12 may range between approximately six inches, for women's shoes, to approximately nine inches, for men's shoes. The back or rear dowel 15*a* needs to be placed so as to support a sole of a low heeled shoe at approximately its midpoint rather than at its toe. Therefore the side walls of the shoe case for women's shoes, which are generally about ten inches long, may be considerably shorter than ten inches, i.e., approximately six inches.

The shoe case 10 may be easily disassembled and the dowels trimmed for use in a closet less deep than the standard closet if desired. Such a situation may be encountered for example, if an irregular space not originally intended for closet use is used as closet. Finally, the shoe case 10 of the present invention may be made very economically because even the finest hardwood dowels cost less than the most inexpensive particle board shelving heretofore used for shoe cases.

With reference again to FIG. 1, the hangbars 20 are fitted into respective vertical support members 30, 31, 35 in a snug manner by the use of a thin and flexible end cap (not illustrated on each end of each hang bar 20. The end caps are preferably made from a plastic or a similar material and serve the additional function of sealing the cut ends of the hang bars 20. The hang bars 20 are preferably made from a strong lightweight material having a smooth surface. In one preferred embodiment, the hang bars 20 are made from a one and one-sixteenth inch O.D. polished chrome-plated steel tube. Clothes hangers slide more easily on the hang bar 20 of the present invention than on the wooden clothes pole of the conventional closet thus making it easier to select a particular article of clothing. Since clothes hangers slide so easily on the smooth surface of the hang bar 20 of the present invention, the shoes in a rear portion of the shoe rack 10 are also easily reached. In order to further improve the sliding action of the clothes hangers, a thin layer of paste wax may be applied to the surface of the hang bar 20.

For the sake of convenience, the vertical support members 30, 31, 35, which may be termed poles, posts or stilts, will be termed stilts because they are elongated preferably rectangular members used for support. Of course the support members or stilts 30, 31, 35 could also be round or have any other desired cross-section. The top hang bar 20*a* is fitted at its ends into respective apertures 39 in the first and second end stilts 30, 31 which may in turn be secured to respective side walls 3*a*, 3*b* of the closet. Preferably, the apertures 39 are located approximately two inches below the top of the stilts 30, 31, 35 so that ample clearance is provided to lift a clothes hanger off the upper hang bar 20*a* even if the top shelf 60 is placed above the stilts. The lower hang bar 20*b* is fitted on a first end into the second end stilt 31 but is fitted on its second end into an intermediate stilt 35 which rests on the floor of the closet and through which the upper hang bar 20*a* also passes. Of course, if the closet is narrow enough and no lower hang bar 20*b* is desired, the intermediate stilt 35 may not be necessary.

A stabilizing arrangement is provided for each end stilt 30, 31. Since both end stilts 30, 31 are identical except for their mirror-image position in the closet and the support of the lower hang bar 20*b* by the second end stilt 31 but not the first end stilt 30, only the first end stilt 30 will be discussed in detail. With reference now to FIG. 3, the stabilizing arrangement or tee-arm includes a cross piece 32 and a rear piece 33. The stilt 30, the cross-piece 32 and the end piece 33 may be made from any suitable material but are preferably made of a strip of wood which may be one and one-half to two inches wide by three-fourth inches thick. These members are preferably made of wood because wood is an inexpensive material which may be drilled and cut without special tools. Normally, the intermediate stilt 35 is also provided with a stabilizing arrangement. The stabilizing arrangement for the center stilt 35, is not crucial to the functioning of the closet storage arrangement, but is useful to help stabilize the center stilt and, perhaps more importantly, to help support the top shelf.

The length of the stilt 30 would depend upon the length of the garments to be hung, the height of the closet space and the height of the hang bars 20 from the floor 2 of the closet. A fastener (not illustrated) would normally attach the stilt 30 to an existing wall cleat 37 (See FIG. 1) in the closet. Normally, the stilt 30 is attached to the cleat 37 of the closet so that a central line of the hang bar or hang bars 20 supported by the stilt is a proper distance from the back wall 4. Approximately eleven or twelve inches from the back wall 4 is the normal distance but the distance is capable of variation as required in a particular closet.

Preferably, the cross piece 32 is approximately twelve to fifteen inches long, the width of the existing top shelf. The stilt 30 is fastened to the cross piece 32 in any conventional fashion such as by a screw (not illustrated). If the closet does not have an existing cleat 37 or if additional support for the stilt 30 is desired, the cross piece 32 may also be fastened to the left side wall 3*a* of the closet by any conventional fasteners.

The back member or back brace 33 may be of any suitable length to provide a good bracing surface against the back wall 4 and is in a preferred embodiment four inches long. To provide a strong connection, the back brace 33 is butted to an inside end of the cross piece 32 and may be secured in position by any conventional fastener, for example, resin coated nails. Any normally used fastener, for example a screw (not illustrated), attaches the back member 33 to the back wall 4.

Unlike conventional closet arrangements which transfer the load imposed on a hang bar to a side wall of the closet or to the back wall of the closet, the stilt 30 of the present invention transfers the load from the hang bars 20 vertically to the floor 2 of the closet. Attaching the stilt 30 to the cleat 37 and hence to the a side wall 3*a*, 3*b*, by a fastener through the stilt, or to the back wall 4 through the cross piece 32 and back member 33 is done mainly to prevent the stilt from swaying sideways and is not done to force the side wall or back wall to bear the load imposed on the hang bars 20 by the clothing supported therefrom. Since the hang bars 20 have a snug fit in their respective apertures 39 in the tilts 30, 31, 35, the vertical loading of the weight suspended from the hang bars 20 provides that the entire stilt arrangement 30, 31, 32, 33, 35 is self stabilizing. That is, the heavier the garment load on the hang bars 20, the sturdier becomes the structure. The stilt stabilizing arrangement of the present invention also makes the closet storage arrangement portable. That is, the stilt structure of the present invention may be moved to a larger closet without having to lengthen the hang bars 20 to extend the stilts 30, 31 to the sidewalls of the larger closet because the stilt stabilizing arrangement may be fastened anywhere along a closet rear wall. Thus both stilts 30, 31 do not have to be attached to a respective side wall of the closet. Conventionally, one stilt would be fastened to a closet side wall but the other stilt would only be fastened to the closet rear wall by the stilt stabilizing arrangement. The closet storage arrangement of the present invention may also be installed in a smaller closet but only when the overall length of the longer hang bar 20*a* is decreased. This may be done by utilizing a pipe cutter (not illustrated) to trim the length of the upper hang bar 20*a*.

Referring again to FIGS. 1 and 2, it should be understood that the front face of the shoe case 10 through which shoes are inserted into and removed from the case is the one facing to the right in FIG. 1. This is the left side of FIG. 2. Such arrangement is most convenient for right handed persons. The mid-portions of both high heel and low heel shoes incline from the horizontal for ready grasping by a hand inserted through the unobstructed front of the case, and this sort of movement is most easily executed by a right hand person with the FIG. 1 arrangement. However, the shoe case 10 is easily reversible to accommodate persons who are left handed.

In this connection, attention is invited to FIGS. 4 and 5. FIG. 4 shows the case 10*a* in much the same orientation as FIG. 1, but FIG. 5 shows it reversed, front to back, so that the front faces to the left for most convenient access by left handed persons.

The shoe case 10*a* has been shown as being shorter than the shoe case of FIG. 1 to illustrate that it is not always necessary to have a shoe case of maximum capacity. It also is shown as having an inverted uppermost tier in which the forward first and second support members 15*b* and 15*c* are above rather than below the rear support member 15*a* to provide for suitable support for high top boots in a manner discussed more fully below.

Both of FIGS. 4 and 5 illustrate a sliding double door having the shoe case installed in a preferred mid-portion of the closet which is not a favored location for hanging clothes. Thus, the most convenient hanging space is preserved virtually without detraction occasioned by the large shoe storage capacity of the case 10. In this embodiment, the closet is in a wall 70 of a room of the house, means such as moulding 71 provides an elongated door opening 72 at the front of the closet in spaced relation to the back wall 4 thereof. Track means 73 and 74 across the door opening support left and right doors 75 and 76 in the usual way for movement between a closed condition as indicated in FIG. 4 and an open condition as indicated in FIG. 5. It will be understood of course that the right side of the closet may be exposed also by moving both doors 75 and 76 to the left of the middle of the closet opening.

Alternatives to the mid-closet shoe case location shown are feasible in many instances. For example, the case 10 of FIG. 4 may be disposed with its rear face adjacent the left side wall of the closet, and the case 10 of FIG. 5 may be disposed with its rear face adjacent the right side wall of the closet.

Other preferred multi-tier shoe storage cases are depicted in FIGS. 6 to 15. Each includes modular sections which can be assembled to provide a shoe rack having a vertical stack arrangement of a desired height and capacity. Such racks are capable of being positioned as side-facing or forward-facing racks within a closet or use outside a closet. It is preferred that these cases be about twenty-two inches wide to adapt them for crosswise positioning in the usual clothes closets in homes.

The modular shoe rack 110 depicted in FIGS. 6–11 comprises a plurality of modules 112A, 112B, which are vertically positioned one above another. A pair of upright hollow posts 113, the hollow interiors 114 of which (FIG. 7) having a polygonal cross-section (preferably rectangular) support a plurality of unitary, shoe carrier structures 116 formed of thin rods or wires preferably of steel coated with paint or plastic.

Each shoe carrier structure 116 comprises a pair of parallel side parts 118 and three horizontally parallel support rod members 120, 122, 124 extending between, and affixed to, the side parts. The side parts are bent so as to form a stepped-like configuration having a generally horizontal proximal section 126, a generally horizontal distal section 128, and an inclined section 130 interconnecting the proximal and distal sections 126, 128. A first or rear one of the support members 120 is connected to the proximal sections 126, and the forward second and third support members 122, 124 are connected to the distal sections 128.

The first support member 120 is disposed at a different elevation than the second and third support members 122, 124 which are situated at a common elevation. In the usual arrangement of the modules, the first support member 120 is situated above the second and third support members 122, 124. The spacial relationships between the support members are such that they are capable of supporting shoes in the same manner as disclosed earlier in connection with FIGS. 1 and 2.

The first support member 120 is situated intermediate the ends of the proximal sections 126 so that the free rear ends 132 of the latter project rearwardly to define mounting pins for mounting the carrier element to the upright posts. That is, the mounting pins 132 enter holes 134 formed in the upright posts 113. The hole edges in the front and back walls of the rectangular (square, as illustrated) post provide bearing surfaces for, and frictionally engage, the free ends 132 of the side parts to hold the shoe carrier structure 116 in cantilever fashion. The vertical spacing between adjacent ones of the mounting holes preferably is up to seven inches to maximize the potential for storing many shoes conveniently. Portions of the pins 132 which project from the rear sides of the posts 113 can receive plastic end caps 136 which form protective covers therefor.

Figure 9:
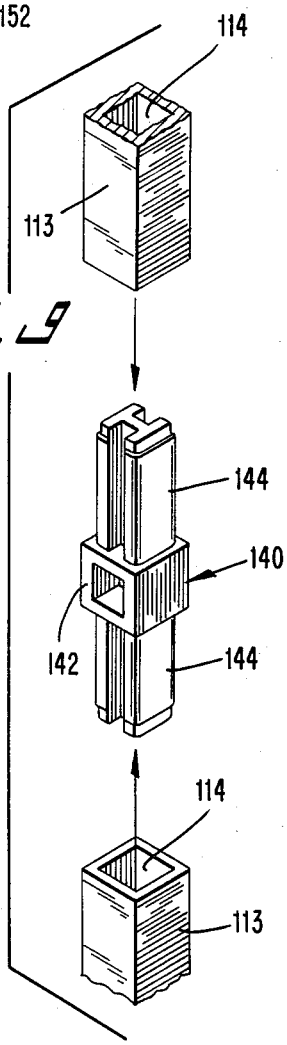
FIG. 9 is a perspective fragmentary view of a coupling member employed to interconnect the vertically aligned posts of FIG. 6.
Figure 8:
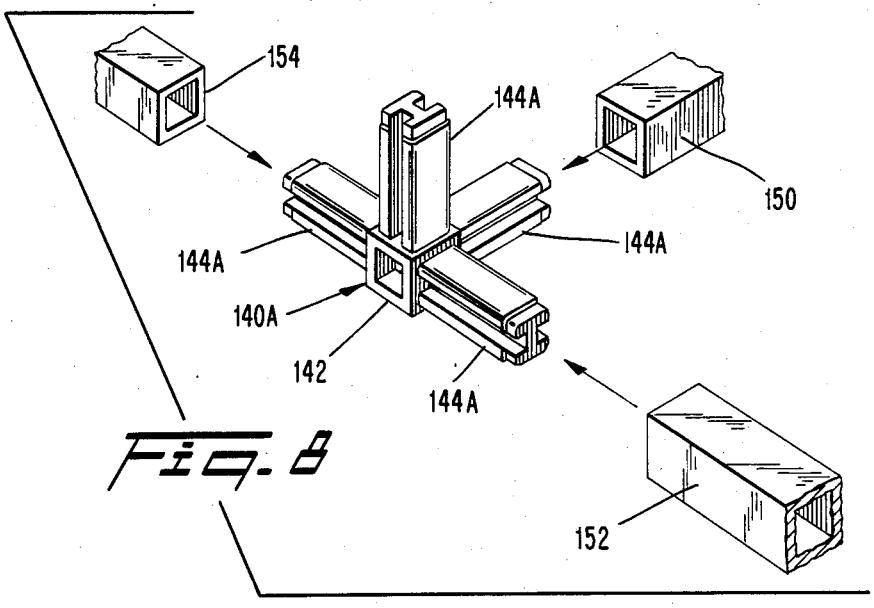
FIG. 8 is a perspective fragmentary view of a coupling member employed to interconnect the posts of FIG. 6 together with a series of ground support bars.

Plural post elements 113 are available for each end of the case. The post elements are interconnected by tongue and socket connections, the tongues of which are provided by separate coupling elements in the form of inserts 140 (FIG. 9). Each insert comprises a base 142 having an outer surface similar in size and shape (e.g., square) to that of the upright posts 113. Projecting from opposite sides of the base are two tongues 144 which are of any suitable configuration capable of fitting with a friction-fit into the sockets 114 defined by the hollow upright posts 113.

By pressing the upright posts onto the tongues 144, a releasable connection is established between the components, with the posts being disposed in vertically superposed relationship. Any desired number of post element of identical or different vertical heights can be placed upon one another to create a shoe rack of a desired height and capacity.

The lowermost module is provided with base-forming bars 150, 152, 154. A first of the base bars 150 extends between the lower ends of the upright posts 113, and the other two base bars 152, 154 extend from the lower end of each upright post 113 in opposite directions oriented perpendicularly to the first base bar 150. To accommodate the base bars, base inserts 140A are employed (FIG. 8) which each have four tongues 144A.

Figure 10:
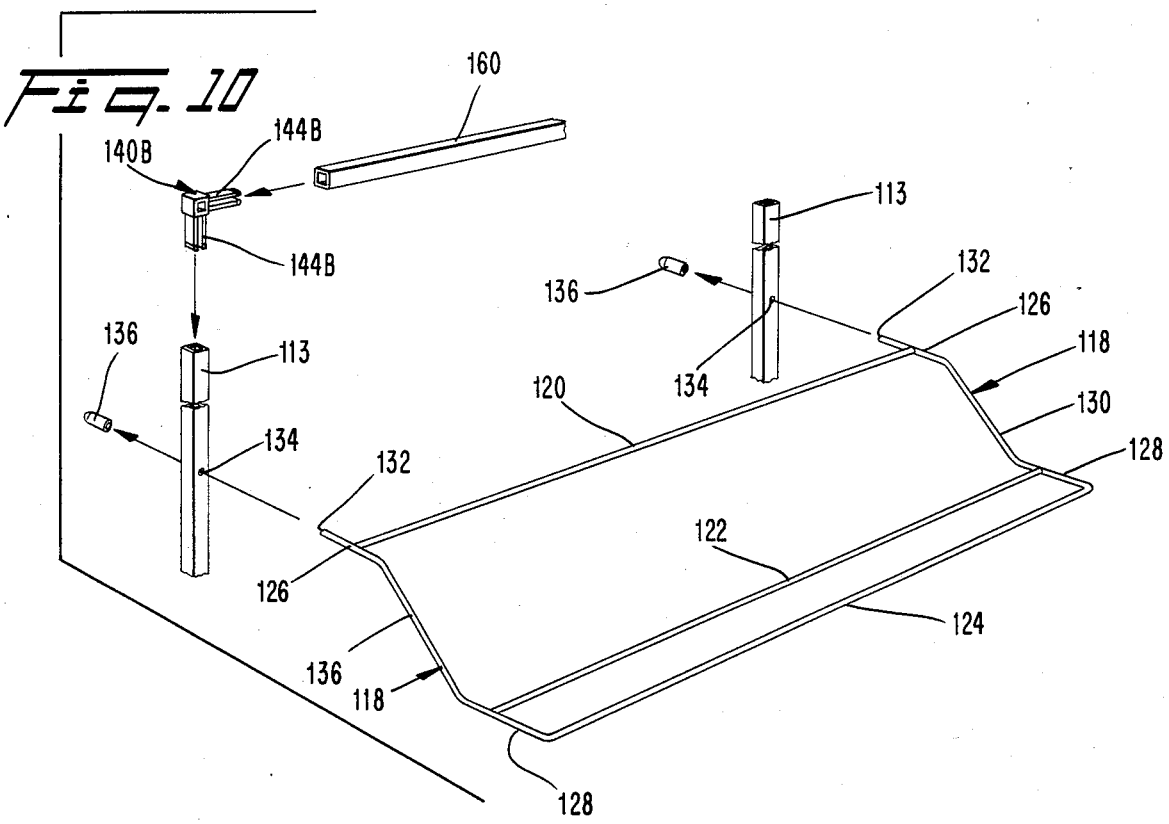
FIG. 10 is an exploded view of the uppermost portion of the shoe rack depicted in FIG. 6.
Figure 11:
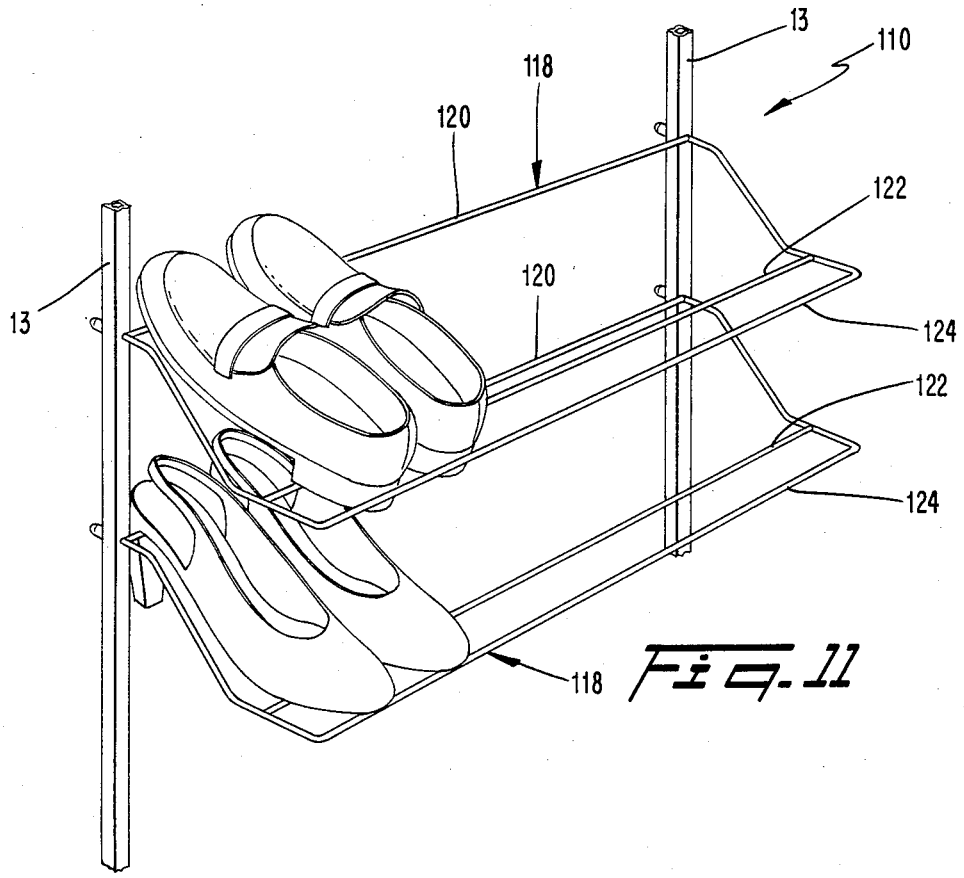
FIG. 11 is a fragmentary perspective view of the shoe or rack depicted in FIG. 6 depicting the manner of mounting shoes thereon.
Figure 12:
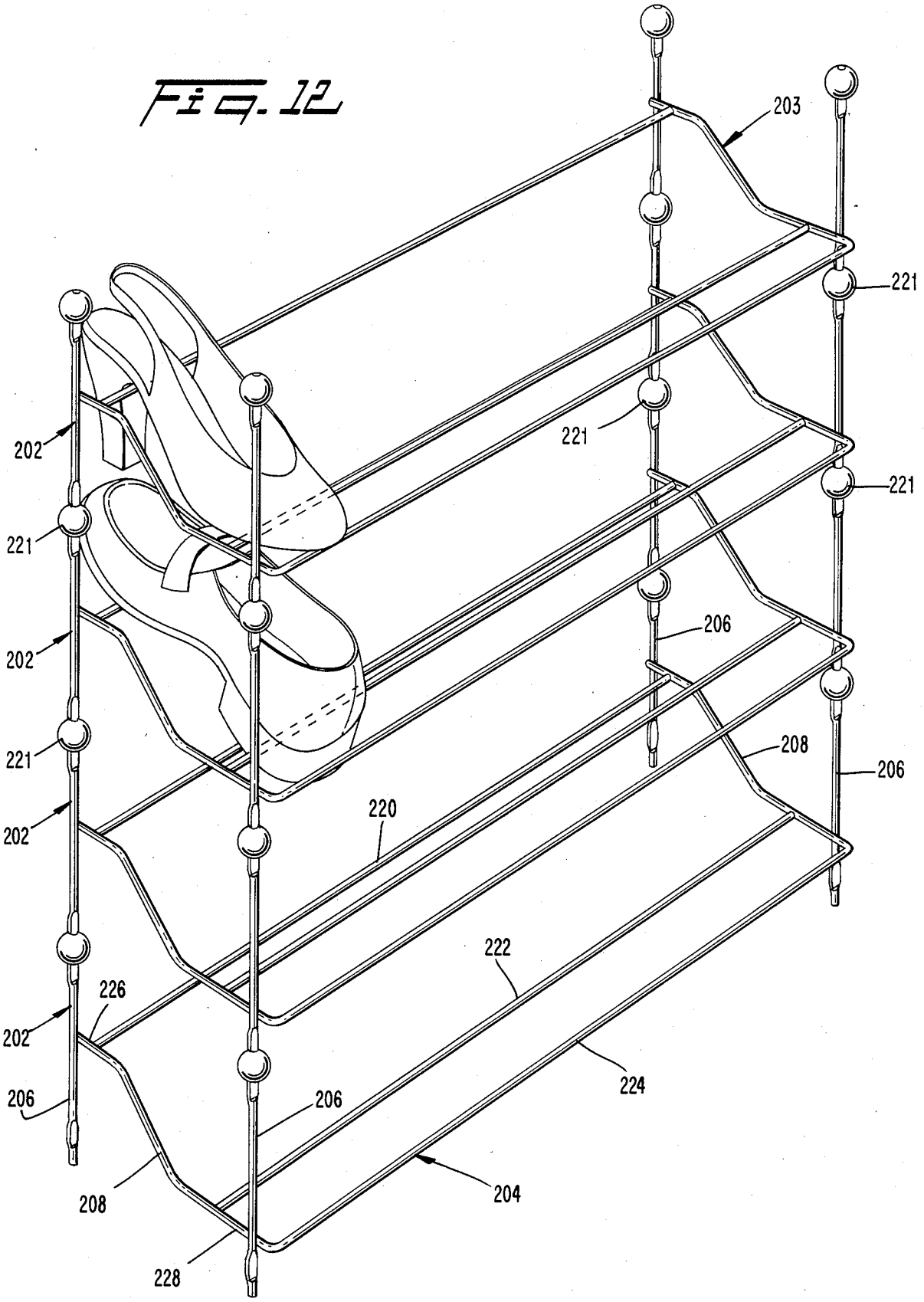
FIG. 12 is a perspective view of another form of multi-tier shoe case or rack, the modules of which are in a mutually assembled condition.

The upper ends of the uppermost upright posts 113 are interconnected by a horizontal stabilizer bar 160 (FIG. 10). Top inserts 140B are provided to accommodate the stabilizer bar, which inserts 140B each have two tongues 144B oriented perpendicularly to one another.

Figure 7:
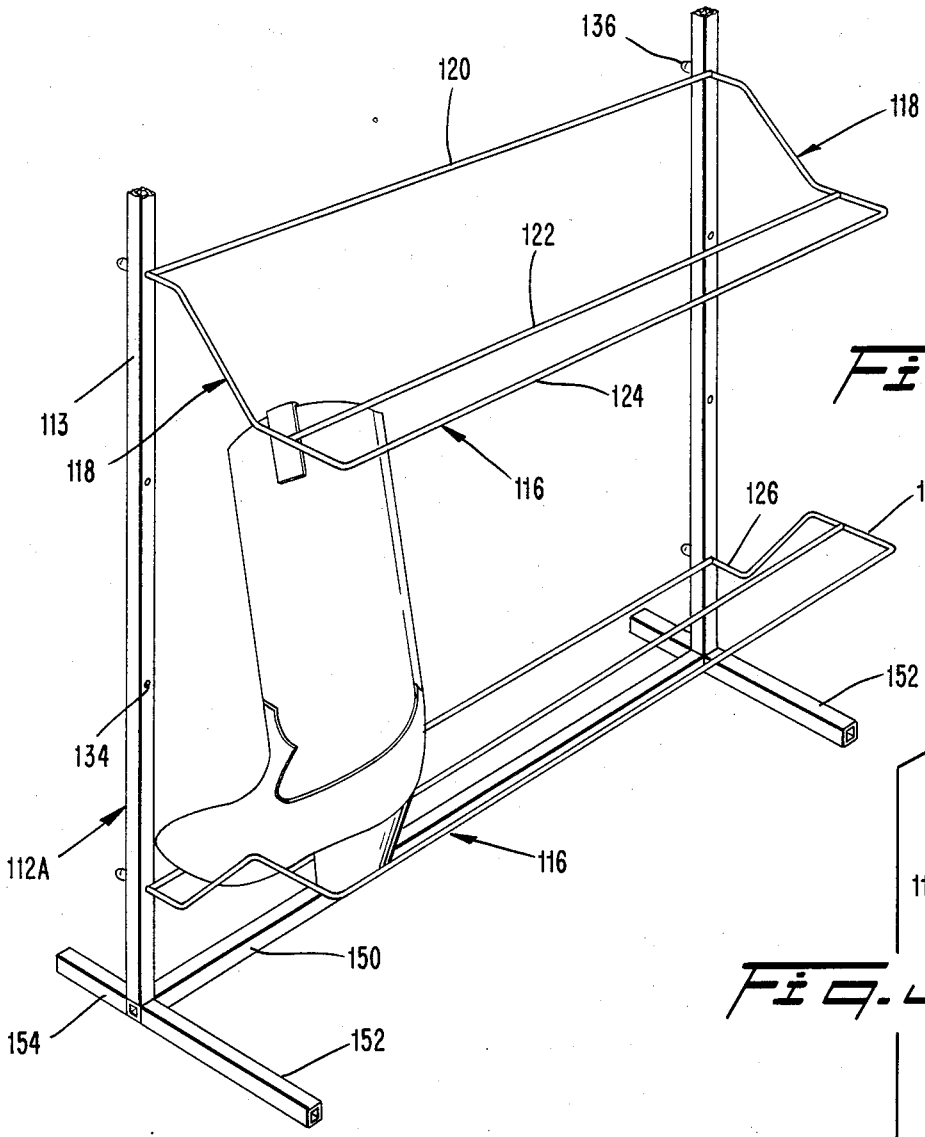
FIG. 7 is a perspective view of one of the modules depicted in FIG. 4, wherein two of the shoe carrier structures have been removed, and a lowermost of them has been inverted to provide for convenient boot storage.

If it is desired to place large shoes such as boots onto the rack, one of the carrier elements 116 could be removed and inverted so as to position the distal section 128 thereof at a higher elevation than the proximal section 126 as depicted in FIG. 7. Also, one or more of the next vertically adjacent carrier element 116 can be removed to increase the vertical spacing above the inverted element 116 to accommodate the boots. The heel portion of the boot would be placed between the support bars 122 and 124, and the toe portion on the lower support bar 120 so that the boots would extend upwardly as shown in FIG. 7.

It will be appreciated that the rack 110 may be assembled quickly and easily. In that regard, since the support members and side parts of each carrier structure 116 are mutually interconnected, a one-piece carrier structure 116 is formed which can be easily mounted to the upright bars or posts 113 without tools. These unitary carrier structures 116 are of shapes which can be nested together for compact packaging and easy transportation to the location of desired use. There is also no need for tools to interconnect the vertical post sections 113 since it is only necessary to push the tongues 144 of the inserts 140 into the sockets of the posts 113, an operation which can be accomplished manually. Therefore, a user can conveniently assemble as many modules as desired to form a rack which is appropriate for the available space and/or desired footware storage capability.

Another form of modular shoe case or rack 200 is depicted in FIGS. 12–15. It comprises a plurality of vertically stacked modules 202 (four modules 202 being depicted in FIG. 12). Each module 202 comprises a shoe carrier structure 204 which is rigidly fixed to four upright posts 206 formed of thin bars or wires of a springy material preferably coated steel or other suitable metal. The carrier structures 204 each comprise two side parts 208 and three support rod members 220, 222, 224 arranged in the same manner as the support members 120, 122, 124 described earlier in connection with FIGS. 4–9.

Two of the upright posts 206 are connected to the proximal section 226 of each carrier structure 204, and the other two posts 206 are connected to the distal section 228 of the carrier structure. The posts 206 are connected to the carrier structure intermediate the ends of the posts, so that portions of the costs project above and below the associated sections of the carrier structure. The posts preferably are about six to seven inches long for racks of large shoe storage capacity.

When interconnecting (stacking) the modules, the posts 206 of an upper module are positioned in superposed relationship relative to the corresponding posts of a lower module (FIG. 13). The forming of the wire posts during manufacture of the carriers is carried out so that all of the posts of one module are unlikely to align precisely with the corresponding posts of an adjacent module when the wire posts are in a relaxed (not flexed) condition.

The slides 221 each comprise a body (FIG. 13) having a through-hole 223 extending therethrough. The body is preferably formed of wood, although other materials may be suitable in some instances. The hole 223 has a cross-sectional dimension corresponding to that of the posts 206 to enable the slides to slide frictionally over the ends of the posts. To assemble the modules, the slides of a first module 202 are positioned at the upper ends of the posts 206 such that the posts extend upwardly about half-way through the holes 223 of the slides 221. An upper module 202 is positioned above the first module with the lower ends of its posts flexed as necessary into superposed relationship above the holes 223 of the slides 221 carried by the first module 206. The posts of the upper module are then pushed downwardly into the holes 223 such that the opposing ends 226 of the posts are disposed within the holes 223 as depicted in FIG. 13. The posts 206 are thus retained in position one above the other by the slides. At a location spaced from each end of each post 206 a distance roughly equal to about half the length of the through-holes 223, each post 206 preferably is provided with a protuberance 225 as a size that will prevent the slide 221 from moving thereover. These protuberances preferably are formed by dimpling or flattening the generally cylindrical wires which make up the posts. If desired, only the upper portion of each post need be dimpled so long as care is taken to assemble the undimpled post ends with post ends that have been dimpled.

The slides 220 are held in position relative to the posts by the normal frictional engagement of each post within the hole 224 and the additional friction created by lateral forces imposed by each post on the side wall of the hole 226 as a result of the flexing of the springy post material which occurs during the interconnection on the modules. That is, since each pair of superposed posts are not normally mutually aligned, they will be slightly deformed from their normal relaxed state once they have been pushed into the slides. Since the posts are formed of a springy material, they will inherently attempt to spring back to their original non-aligned shape, thereby continually exerting lateral forces against the side walls of the holes 124 to effectively resist any tendency for the slides to gravitate downwardly. Accordingly, the slides will remain in a joint-covering position until a module is pulled free of the slides by a user.

What is claimed is:

1. A household closet having enhanced capacity for storing clothing and footwear items for men and women, comprising:

a floor;

two transversely spaced apart left and right side walls;

a back wall extending between said side walls;

means having a door opening spaced forwardly from said back wall;

a generally horizontal hang bar mounted so that the axis thereof extends generally transversely of the closet at a location between said back wall and said door opening and being accessible through said door opening for supporting garments on hangers suspended from said hang bar;

a multi-tier shoe case supported on said floor at a location between said back wall and said door opening and between said side walls, said shoe casing facing sideways in the closet to minimize the lateral clothes hanging space made unavailable for hanging clothes by said shoe case, said shoe case having a rear end near said back wall and a front end spaced forwardly a fixed distance from said rear end toward said door opening, said shoe case further having a generally vertical face side through which shoes conveniently may be inserted and a generally vertical opposite side, said generally vertical face side of said shoe case being open for easy visibility of shoes in said case, each tier of said shoe case being provided by three unitary horizontal shoe support members mounted to extend from back to front of the closet, a first of said shoe support members of each tier being located near said opposite side of the shoe case at a first level and the second and third of said shoe support members of each tier being located near said face side of the shoe case in horizontally spaced relationship one to another at a lower second level;

the horizontal spacing between said second and third support members of a tier being great enough to cause the rear of a low heel shoe whose front sole portion has been rested on said first support member to bear against an inside portion of the outermost of said second and third support members to prevent the shoe from sliding off the shoe support members; and, the spacing between said second and third support members and said first support member of a tier being such that a high heel shoe may be securely supported on the support members of the tier with its front sole portion resting on at least one of said second and third support members and its heel hooked over said first support member.

2. A closet as defined in claim 1, wherein said shoe case extends upwardly from the floor to a level higher than that of said hang bar, and wherein said hang bar extends through said shoe case.

3. A closet as defined in claim 1 wherein said shoe case is disposed approximately midway between said left and right side walls of said closet, said closet further comprising a vertical support member resting on the floor of said closet at a location within a central portion of the closet adjacent said generally vertical opposite side said shoe case, and a second hang bar supported at a level lower than said first hang bar by said vertical support member and extending from said vertical support member transversely of said closet toward one side of the closet to permit hanging of garments at two different levels within the closet.

4. A closet as defined in claim 1, wherein said shoe case is spaced apart from both said left and right side walls of the closet and is reversible from a first position wherein its generally vertical face side faces toward the left side wall of the closet to facilitate easy insertion or withdrawal of shoes by left-handed persons to a second position wherein its generally vertical face side faces toward the right side wall of the closet to facilitate easy insertion or withdrawal of shoes by right-handed persons.

5. A closet as defined in claim 1, additionally comprising two doors of widths about one-half the widths of said door opening, each such door being slidably mounted for movement across substantially the entire width of said door opening so that when both of the doors are located at the left side of the opening access to the interior of the closet may be had through a right side portion of the opening and when both of the doors are located at the right side of the opening access to the interior of the closet may be had through a left side portion of the opening, and wherein the location of said shoe case is at about the middle of said door opening.

6. A multi-tier shoe case of open work construction for storing in a readily visible condition both low heel and high heel shoes in upright positions with portions of their soles being supported from below and with mid-portions thereof inclined upwardly away from a substantially unobstructed front side of the case to permit easy grasping of the shoes by a user of the shoe case, comprising:

mounting means extending vertically at the ends of said case; the mounting means at one end of the case being spaced horizontally from the mounting means at the other end of the case a fixed distance no greater than about twenty-three inches so that the shoe case may be fitted in a closet in sidewise facing relationship thereto and supported on the floor thereof;

a plurality of unitary horizontal shoe support members carried by and extending unobstructedly across the space between said mounting means, said members being arranged in a predetermined orientation and defining a plurality of vertically spaced tiers for storing shoes in the shoe case, each tier consisting essentially of a rear support member, a forward first support member and a forward second support member, wherein said two forward support members are horizontally spaced apart and both forward support members are at substantially the same level spaced vertically below said rear support member;

the horizontal spacing between said forward first and forward second support members of each tier being great enough to cause the rear of a no-heel or low heel shoe whose front sole portion has been rested on said rear support member to bear against an inside portion of the forward first support member to prevent the shoe from sliding off the shoe support members but being narrow enough to prevent no heel shoes from falling through such space; and the spacing between said forward support members and said rear support members of each tier being sufficient that a high heel shoe may be securely supported on the support members of the tier with its front sole portion resting on at least one of said forward support members and its heel hooked over said rear support member.

7. A shoe case according to claim 6 and wherein in each tier said forward shoe support members are spaced approximately one to two inches from each other, said rear support member is spaced about two and one-half inches above said forward support members and is also spaced approximately three to five inches rearwardly of a rearward one of said forward support members.

8. A shoe case according to claim 6 wherein said tiers are vertically spaced approximately six to seven inches from each other.

9. A multi-tier shoe case of open work construction for storing in a readily visible condition both low heel and high heel shoes in upright positions with portions of their soles being supported from below and with mid-portions thereof inclined upwardly away from a substantially unobstructed front side of the case to permit easy grasping of the shoes by a user of the shoe case, comprising:

mounting means extending vertically at the ends of said case; the mounting means at one end of the case being spaced horizontally from the mounting means at the other end of the case a distance no greater than about twenty-three inches so that the shoe case may be fitted in a closet in sidewise facing relationship thereto;

a plurality of horizontal shoe support members carried by and extending unobstructedly across the space between said mounting means, said members being arranged in a predetermined orientation and defining a plurality of vertically spaced tiers for storing shoes in the shoe case, each tier consisting essentially of a rear support member, a forward first support member and a forward second support member, wherein said two forward support members are horizontally spaced apart and both forward support members are spaced vertically below said rear support member;

the horizontal spacing between said forward first and forward second support members of each tier being great enough to cause the rear of a no-heel or low heel shoe whose front sole portion has been rested on said rear support member to bear against an inside portion of the forward first support member to prevent the shoe from sliding off the shoe support members but being narrow enough to prevent no heel shoes from falling through such space; and the spacing between said forward support members and said rear support members of each tier being sufficient that a high heel shoe may be securely supported on the support members of the tier with its front sole portion resting on at least one of said forward support members and its heel hooked over said rear support member;

said shoe case additionally comprising an inverted tier also having a rear support member, a forward first support member and a forward second support member, with said two forward support members of the inverted tier being horizontally spaced apart but with both forward support members being vertically above said rear support member to condition the module for effective storage of boots with the heel portions thereof held by the two forward support members, with the soles of the toe portions thereof resting upon the rear support member, and with the ankle portions thereof extending upwardly within the shoe case from the set of support members.

10. A multi-tier shoe case of open work construction for storing in a readily visible condition both low heel and high heel shoes in upright positions with portions of their soles being supported from below and with midportions thereof inclined upwardly away from a substantially unobstructed front side of the case to permit easy grasping of the shoes by a user of the shoe case, comprising:

mounting means extending vertically at the ends of said case; the mounting means at one end of the case being spaced horizontally from the mounting means at the other end of the case a distance no greater than about twenty-three inches so that the shoe case may be fitted in a closet in sidewise facing relationship thereto;

a plurality of horizontal shoe support members carried by and extending unobstructedly across the space between said mounting means, said members being arranged in a predetermined orientation and defining a plurality of vertically spaced tiers for storing shoes in the shoe case, each tier consisting essentially of a rear support member, a forward first support member and a forward second support member, wherein said two forward support members are horizontally spaced apart and both forward support members are spaced vertically below said rear support member;

the horizontal spacing between said forward first and forward second support members of each tier being great enough to cause the rear of a no-heel or low heel shoe whose front sole portion has been rested on said rear support member to bear against an inside portion of the forward first support member to prevent the shoe from sliding off the shoe support members but being narrow enough to prevent no heel shoes from falling through such space; and the spacing between said forward support members and said rear support members of each tier being sufficient that a high heel shoe may be securely supported on the support members of the tier with its front sole portion resting on at least one of said forward support members and its heel hooked over said rear support member, said support members of each tier being incorporated in a unitary carrier structure having side parts joined to the end portions of said support members, wherein upright posts are provided, and wherein said carrier structures are connected to said posts.

11. A shoe case according to claim 10 wherein said posts are provided with generally horizontal mounting holes therethrough and wherein said side parts of said carrier structures include free end portions for insertion into said mounting holes so that the carrier structures will project in cantilever fashion from said posts.

12. A shoe case according to claim 11 wherein a plurality of said unitary carrier structures are substantially identical in construction and shape, each such carrier structure consisting essentially of generally cylindrical coated metal wire formed to provide said support members and two side parts, each of said side parts extending generally horizontally rearwardly across the ends of said two forward support members, then extending rearwardly at an angle to the horizontal to the level of said rear support member, then extending rearwardly horizontally past said rear support member and terminating in said free end portion, said unitary carrier structures being nestable together to provide for compact packing thereof for shipment to a location of intended use of the shoe case and assembly there with said posts;

said posts being of generally hollow rectangular cross sections with said mounting holes being circular and extending through both the front and back walls thereof to provide bearing areas for said free end portions of said side parts of said unitary carrier structures.

13. A shoe case according to claim 10 wherein there are a plurality of posts aligned vertically at each end of the case, and wherein coupling members are provided for frictionally engaging the adjacent end portions of aligned posts to releasably retain such posts in vertically stacked relationship.

14. A shoe case according to claim 13, wherein the adjacent end portions of said aligned posts are hollow and form sockets, said coupling members each comprising an insert having tongues which are frictionally received in said sockets.

15. A case according to claim 14 including separate base bars connected to lower ends of the lowermost posts to support said case on the floor, and a reinforcing bar interconnecting the upper ends of the uppermost posts at each end of the case, said base bars and said reinforcing bar being connected to said posts by inserts having tongues which are frictionally received in sockets of said posts, said base bars, and said reinforcing bar.

16. A shoe case according to claim 13, wherein each of said coupling members comprises a hollow slide having a through-hole into which the adjacent end portions of aligned posts extend to be held within said through-hole in mutual alignment by a frictional fit.

17. A shoe case according to claim 16, wherein a plurality of said tiers each comprises four said posts permanently connected to one of said unitary carrier structures, and wherein such posts and carrier structures consist essentially of generally cylindrical coated metal wires.

* * * * *